US005685608A

United States Patent [19]

Yamazaki

[11] Patent Number: 5,685,608

[45] Date of Patent: Nov. 11, 1997

[54] FOLDING SEAT AND SEATING SYSTEM HAVING FOLDING SEAT

[75] Inventor: Ryokichi Yamazaki, Chiba, Japan

[73] Assignee: Kotobuki Corporation, Japan

[21] Appl. No.: 603,619

[22] Filed: Feb. 21, 1996

[30] Foreign Application Priority Data

Feb. 28, 1995 [JP] Japan ..... 7-040160

[51] Int. Cl.[6] ..... A47C 1/12

[52] U.S. Cl. ..... 297/335; 297/217.7; 297/232; 297/257; 52/9

[58] Field of Search ..... 297/217.7, 257, 297/232, 331, 334, 335, 336, 15, 332; 52/7, 8, 9, 10

[56] References Cited

U.S. PATENT DOCUMENTS

| | | | |
|---|---|---|---|
| 3,025,106 | 3/1962 | Evans et al. . | |
| 3,703,312 | 11/1972 | Chapman . | |
| 4,000,586 | 1/1977 | Vance et al. | 297/236 |
| 4,063,392 | 12/1977 | Van Ryn et al. | 297/236 |
| 4,155,202 | 5/1979 | Hartman | 297/236 |
| 4,211,450 | 7/1980 | Sutter | 297/232 |
| 4,294,048 | 10/1981 | Sutter | 297/232 |
| 4,557,080 | 12/1985 | Walworth et al. | 297/332 |
| 5,328,238 | 7/1994 | Yamazaki | 297/332 |

FOREIGN PATENT DOCUMENTS

| | | |
|---|---|---|
| 0539929 | 5/1993 | European Pat. Off. . |
| 4-56611 | 9/1992 | Japan . |

OTHER PUBLICATIONS

PCT/US97/00585, Aug. 6, 1979, Crossman et al.

*Primary Examiner*—Peter M. Cuomo
*Assistant Examiner*—Anthony D. Barfield
*Attorney, Agent, or Firm*—Suzuye & Suzuye

[57] ABSTRACT

A seat comprises a first frame rotatable between a first position where the frame is raised from a floor surface and a second position where said frame is horizontally moved down along the floor surface, and a second frame rotatable between a raise position where the frame is raised from the floor surface and a folding position where the frame is horizontally moved down along the floor surfaces at the back of the first frame. The first and second frames are interlocked each other through arm rest. A seat cushion is rotatably supported on the first frame. A back rest is supported on the second frame to be rotatable in back and forth directions through a pivot shaft. The back rest and the first frame are interlocked each other through a link member. The link member rotates the back rest in a direction where the lower end portion of the back rest is drawn forward when the first frame is rotated to the first position. The back rest and the arm rest are rotatably supported by the second frame through the common pivot shaft.

9 Claims, 12 Drawing Sheets

FOLDING SEAT AND SEATING SYSTEM HAVING FOLDING SEAT

BACKGROUND OF THE INVENTION

1. Field of the Invention

The present invention relates to a folding seat and more particularly to a seat rotatable between a storage position where the seat is folded along a floor surface and a use position where the seat is raised from the floor surface and more particularly to a seating system having such a folding seat.

2. Description of the Related Art

The so-called movable seating system in which the arrangement of seat and the number of seats can be changed in accordance with kinds of events has been widely used in multi-purpose facilities such as a hall, and a stadium. Japanese Utility Model Application KOKAI Publication No. 5-39355 discloses such a seating system. More specifically, in the seating system disclosed in the above publication comprises a stepwise deck having a plurality of upper surfaces whose height from a floor surface is different. The decks are mounted on the floor surface to be movable between a storage position where the upper surfaces are stacked in a shelf form and a use position where the upper surfaces are expanded stepwise. If the decks are moved to the storage position, the upper surfaces, which are placed at the lower position, are sequentially guided to a space of the lower side of the upper surfaces placed at the higher position. Then, the entire decks are stored along a wall surface connected to the floor surface. In a state that the decks are stored into the wall surface, the upper surfaces having different height from the floor surface are opposed to each other in up and down directions, so that a storing space is formed between these upper surfaces.

If the decks are moved from the storage position to the use position, the plurality of the upper surfaces are continuously drawn from the wall surface, thereby stairs having a plurality of steps are formed on the floor surface.

A plurality of folding seats are arranged on the upper surface in a row. These seats have a pair of supports. The supports are provided onto the upper surface of the deck to be rotatable between a first position where the supports are substantially perpendicularly raised from the upper surface of the deck and a second position where the supports are substantially horizontally moved down to be parallel with the upper surface of the deck. A seat cushion is provided between these supports. A left side surface of a rear end portion of the seat cushion and a right side surface thereof are rotatably supported by these supports. Due to this, in a state that the supports are rotated to the first position, the seat cushion is rotated to each of a use position where the seat cushion is substantially horizontally set, a storage position where the seat cushion is substantially vertically raised along the supports, an intermediate position between the use position and the storage position.

The above-mentioned seat has a back rest. The back rest is attached to the upper surface of the deck through a pair of legs. The back rest is movable between a raise position where the back rest is raised from the upper surface of the deck and a folding position where the the back rest is moved down substantially horizontally along the upper surface of the deck. The back rest is structured to be raised at the back of the supports when the back rest is rotated to the raise position.

Moreover, the above-mentioned seat has a pair of arm rests. The arm rests are substantially horizontally provided to be stretched between the top end portion of the supports and the back rest. The arm rests are rotatably connected to the supports and the back rest through a pivot. Due to this, the arm rests function as connection rods for interlocking the supports and the back rest each other.

In the above-structured seat, if the supports are rotated from the second position to the first position, movement of the supports is transmitted to the back rest through the arm rests, and the back rest follow the movement of the supports to be rotated from the fold position to the raise position. Due to this, the seat cushion is rotated to be substantially a horizontal posture, and the back rest is raised in the vicinity of the rear end of the seat cushion.

Moreover, if the supports are rotated from the first position to the second position, the back rest follows the movement of the supports to be rotated to posture such that the back rest substantially horizontally falls to the front. Due to this, the back rest and the seat cushion are overlaid on each other, and the entire seat are flatly folded along the upper surfaces of the deck. Therefore, in a state that the decks are stored along the wall surface, the folded seat is stored in the storage space.

However, in the above-mentioned seat, since the supports and the back rest are interlocked by the arm rests, the raise angle of the back rest is determined by a distance from a connecting point between the arm rests and the supports to a connecting point between the back rest and the supports. Due to this, in a state that the supports are rotated to the first position, the raise angle of the back rest cannot be singly changed. Therefore, there is left room for further improvement of keep the raise angle of the back rest suitable for seating.

On the other hand, in the above-mentioned folding seat, the back rest is raised at the back end portion of the seat cushion in a state that the supports are rotated to the first position. Then, the back rest is inclined to be expanded backward as advancing upward. Due to this, the upper end of the back rest is positioned backward than the lower end of the back rest.

The upper surfaces of the deck on which the seat is mounted are arranged stepwise, and the level difference between the adjacent upper surfaces are suitably determined in accordance with the specification of the seating system. The back rest is inclined to have the above-mentioned posture. Due to this, in the seating system in which the level difference between the upper surfaces is small, the front end of the upper surface of the next high step is positioned close to the lower end portion of the back rest. Therefore, the distance between the front end of the upper surface of the deck and the back surface of the back rest becomes wider, so that an audience may lose his footing from the upper surface of the deck in seating. Conversely, in the seating system in which the level difference between the upper surfaces is large, the front end of the upper surface of the next high step is positioned close to the intermediate portion of the back rest in the height direction. Due to this, the distance between the front end of the upper surface of the deck and the back surface of the back rest becomes narrower. Then, when the audience seats the seat, the back rest is bent to interface with the next high step. As a result, there is a problem in which the back surface of the back rest is damaged or made dirty.

In order to solve the above problem, in the conventional seating system, the attaching position of the seat is adjusted back and forth or up and down in accordance with the level difference between the upper surfaces of the deck so as to maintain the distance between the front end of the upper surface of the deck and the back surface of the back rest. However, if the attaching position of the seat is adjusted in accordance with the specification of the seating system, much time and working are needed to install the seat, and workability becomes worse.

SUMMARY OF THE INVENTION

A first object of the present invention is to provide a folding seat in which a back rest can be inclined to have a suitable angle, no shaft dedicated to ratably support the back rest, thereby making possible to simplify the structure.

A second object of the present invention is to provide a folding seat in which thickness of the seat can be thinned when a back rest and a seat cushion are folded even if the back rest is inclined to have a suitable angle.

A third object of the present invention is to provide a seating system in which an attachment of a seat can be easily made, and a thickness of the seat can be thinned when the seat is folded.

In order to achieve the first object, there is provided a folding seat comprising a first frame mounted on a floor surface, the first frame rotatable between a first position where the frame is raised substantially perpendicularly raised from the floor surface and a second position where the frame is horizontally moved down to be parallel to the floor surface; a seat cushion supported by the first frame, the seat cushion rotatable between a use position extended substantially horizontally from the first frame rotated to the first position and a storage position raised substantially perpendicularly along the first frame rotated to the first position; a second frame mounted on the floor surface at the back of the first frame, the second frame rotatable between a raise position where the frame is substantially perpendicularly from the floor surface and a folding position where the frame is horizontally moved down to be parallel to the floor surface; an arm rest substantially horizontally provided to be stretched between the first frame and the second frame, the arm rest rotatably connected to the first frame in a vertical direction through a first pivot shaft, the arm rest rotatably connected to the second frame in a vertical direction through a second pivot shaft, and the first and second frames interlocked each other through the arm rest; a back rest rotatably supported on the second frame through the second pivot shaft in back and forth directions, the back rest extended upward from a rear end portion of the seat cushion when the second frame is rotated to the raise position, and extended substantially horizontally along the seat cushion when the second frame is rotated to the folding position; and a link member provided to be stretched between the back rest and the first frame, the link member having one end rotatably connected to the back rest in a vertical direction and other end rotatably connected to the first frame in a vertical direction, and the link member rotates the back rest in a direction where the lower end portion of the back rest is drawn forward when the first frame is rotated to the first position from the second position.

According to the above structure, the first and second frames are interlocked each other through the arm rest. Due to this, if the first frame is rotated to the first position from the second position, movement of the first frame is transmitted to the second frame through the arm rest. Therefore, the second frame follows the first frame so as to be rotated from the folding position to the raise position.

If the first frame is rotated to the first position, the back rest is raised, and the lower end portion of the back rest is drawn forward through the link member. Thereby, the back rest is singly rotated in the state that the second pivot shaft is used as a fulcrum, so that the inclination angle of the back rest is increased. Therefore, the back rest can be inclined to have an angle, which is suitable for seating.

The back rest is supported by the second frame through the second pivot shaft, using a rotational fulcrum of the arm rest. Due to this, the arm rest and the back rest can have the same rotational fulcrum in common. As a result, the shaft, which is dedicated to support the back rest, is not needed, and the bearing section for receiving the shaft can be omitted from the second frame. Therefore, the number of parts of the seat can be reduced, and the structure of the seat can be simplified.

Moreover, in order to achieve the second object, the seat of the present invention is characterized in that the link member rotate the back reset to be substantially horizontally along the first frame when the first frame is rotated to the second position from the first position.

According to the above structure, the back rest can be rotated to be parallel to the floor surface at the time when the first frame is rotated to the second position. Due to this, the thickness of the seat can be reduced at the time of folding the seat even if the inclination angle of the back rest is increased when the first frame is rotated to the first position.

In order to achieve the third object, there is provided a seating system, including a floor surface, stepwise decks having a plurality of upper surfaces whose height from the floor surface are different from each other, and a seat arranged on the upper surfaces of the decks, the seat comprising a first frame mounted on each of the upper surfaces of the decks, the first frame rotatable between a first position where the frame is substantially perpendicularly raised from the upper surfaces and a second position where the frame is horizontally moved down to be parallel to the upper surfaces; a seat cushion supported by the first frame, the seat cushion rotatable between a use position extended substantially horizontally from the first frame rotated to the first position and a storage position raised substantially perpendicularly along the first frame rotated to the first position; a second frame mounted on each of the upper surfaces of the decks at the back of the first frame, the second frame rotatable between a raise position where the frame is substantially perpendicularly raised from the upper surfaces and a folding position where the frame is horizontally moved down to be parallel to the upper surfaces, the second frame having a rear panel raised substantially perpendicularly at a position adjacent to a front end of the upper surface of the back higher step when the second frame is rotated to the raise position, and an upper end of the rear panel positioned upward than the upper surface of the back higher step; an arm rest substantially horizontally provided to be stretched between the first frame and the second frame, the arm rest rotatably connected to the first frame in a vertical direction through a first pivot shaft, the arm rest rotatably connected to the second frame in a vertical direction through a second pivot shaft, and the first and second frames interlocked each other through the arm rest; a back rest rotatably supported on the second frame through the second pivot shaft in back and forth directions, the back rest is inclined to be projected upward from the upper end of the rear panel and to be extended backward than the rear panel in accordance with upper advancement when the second frame is rotated to the raise position; and a link member provided to be stretched between the back rest and the first frame, the link member having one end rotatably connected to the back rest in a vertical direction and other end rotatably connected to the first frame in a vertical direction, and the link member rotates the back rest to be parallel to the rear panel when the first frame is rotated from the first position to the second position.

According to the above-mentioned structure, if the first frame is rotated to the first position from the second position, movement of the first frame is transmitted to the second frame through the arm rest, so that the second frame follows the first frame, and is rotated to the raise position from the folding position.

If the second frame is rotated to the raise position, the rear panel is raised just before the upper surface of the backward higher step. Due to this, even if the level difference between the upper surfaces of the decks is changed in accordance with the specification of the seating system, the distance between the upper surfaces of the decks and the rear panel positioned before the upper surfaces can be constantly maintained. Thereby, it is not needed that the attaching position of the seat be shifted back and forth in accordance with the level difference between the upper surfaces of the decks. Moreover, it is not required that the height of the attachment be changed. Therefore, the attachment of the seat can be easily made.

If the first frame is rotated to the first position from the second position, the back rest is inclined backward in accordance with the upward advancement. Due to this, the inclination angle of the back rest becomes larger than the raise angle of the rear panel, so that the back rest can be inclined to have an angle, which is suitable for seating.

Moreover, according to the above-mentioned structure, if the first frame is rotated to the second position from the first position, the back rest is rotated to be along the rear panel through the link member. Due to this, although the back rest is projected to the backward of the rear panel at the time of using the seat, the back rest is structured to be substantially parallel to the upper surfaces of the decks in the state that the seat is folded, and the thickness of the folded seat is thinned.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 1 is a side view of a seating system having a folding seat mounted on an upper surface of a movable deck;

FIG. 2 is a front view of the seating system to show a state in which the folding seat is mounted on the upper surface of the deck;

FIG. 3 is an exploded view of the seat of FIG. 1 and a perspective view thereof;

FIG. 4 is a side view of the seat showing a state that a first frame is rotated to a first position and a seat cushion and a back rest are unfolded to be a use state;

FIG. 5 is a side view of the seat showing a state that the seat cushion is rotated to a storage position;

FIG. 6 is a side view of the seat showing a state that a first frame is rotated to a second position and the seat cushion and the back rest are folded;

FIG. 7 is a side view of the seat showing a state that the first frame is rotated between the first and second positions;

FIG. 8 is a side view of the seat showing a positional relationship among four pivot points on the seat and a rotational locus of each of these pivot points;

FIG. 9 is a side view of the seating system having a folding seat mounted on an upper surface of a movable deck;

FIG. 10 is a side view of the seat showing a state that a first frame is rotated to a first position and a seat cushion and a back rest are unfolded to be a use state;

FIG. 11 is a side view of the seat showing a state that a first frame is rotated to a second position and the seat cushion and the back rest are folded; and FIG. 12 is a side view of the seat showing a positional relationship among four pivot points on the seat and a rotational locus of each of these pivot points.

DETAILED DESCRIPTION OF THE PREFERRED EMBODIMENTS

The following will explain a first embodiment with reference to FIGS. 1 to 8.

Figure 1:
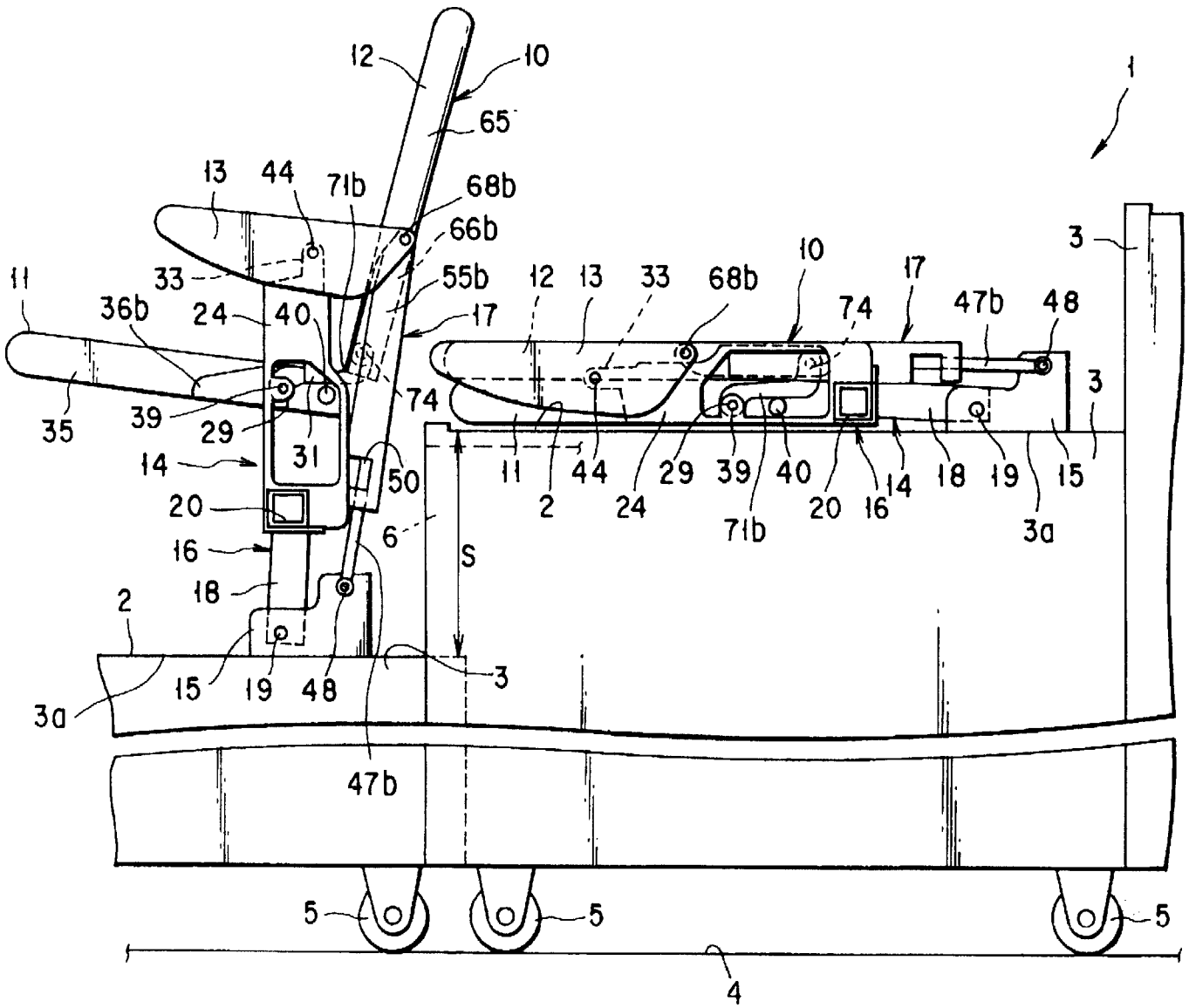
FIGS. 1 to 8 show a first embodiment of the principles of the invention.

FIG. 1 shows a movable seating system 1, which is used in a multi-purpose facility such as a hall, and a stadium. The seating system 1 is mounted on a flat floor surface 4 of the multi-purpose facility. The seating system 1 comprises a plurality of movable decks 3. Each of the decks 3 has a step 3*a* having an upper surface 2. The respective steps 3*a* have a different height from the floor surface 4. The decks 3 are arranged such that the respective upper surfaces 2 become higher in order as the upper surfaces 2 advance from a front end of the seating system 1 to a back end. A level difference S between the upper surfaces 2 of the adjacent decks 3 is fixed in accordance with a specification of the seating system 1. Due to this, the decks 3 are structured such that steps are formed on the floor surface 4.

The decks 3 are provided to be movable on the floor surface 4 through wheels 5. In other words, the lower deck 3 enters a space positioned at the lower side of the higher deck 3. Then, the decks 3 are mounted on the floor surface 4 to be movable between a storage position where steps 3*a* are stacked in a shelf form and a use position where steps 3*a* are expanded stepwise. In a state that the decks 3 are moved to the storage position, the entire seating system 1 is folded flatly along a wall surface of the multi-purpose facility to be stored in the wall surface. Then, in this state, a flat storage space 6 is formed between two steps 3*a* stacked each other.

Figure 2:
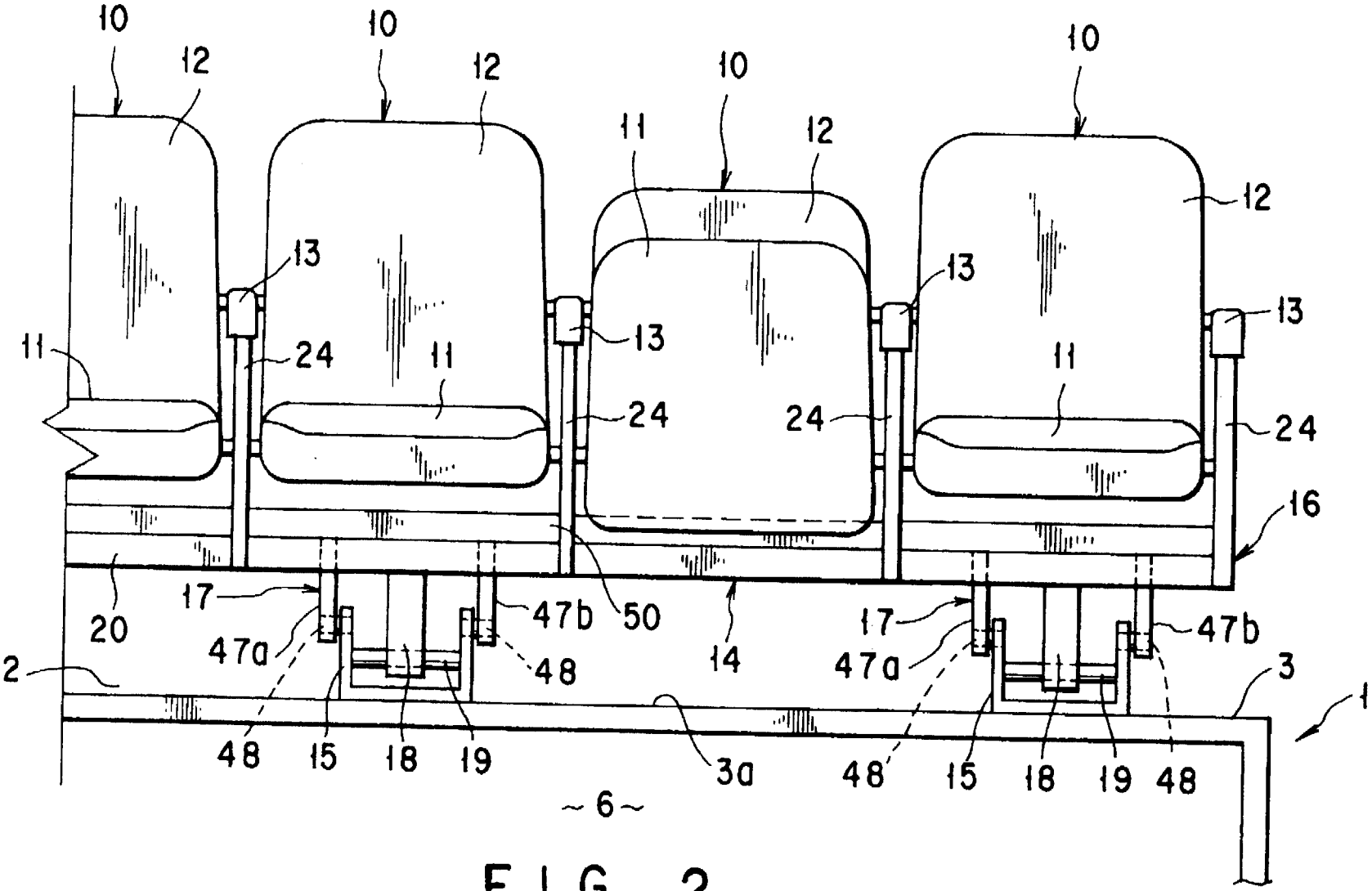

As shown in FIGS. 1 and 2, a plurality of folding seats 10 are arranged on the upper surface 2 of each of the decks 3 in a row. Each of seats 10 has a seat cushion 11, a back rest 12, a pair of arm rests 13, and a seat support frame 14 for supporting the seat cushion 11, the back rest 12, and the arm rests 13.

The seat support frame 14 integrally supports the plurality of the seat cushion 11 and the back rest 12 in a state that these seat cushion 11 and the back rest 12 are arranged on the upper surface 2 of the step 3*a*. The seat support frame 14 has a plurality of bases 15, a first frame 16 supported by these bases 15, and a second frame 17. As shown in FIG. 2, the bases 15 are fixed to the rear portion of the upper surface 2 of each of the decks 3 to have a distance in right and left directions of the seating system 1. The height of each of the bases 15 is set to be smaller than that of the storage space 6.

Figure 3:
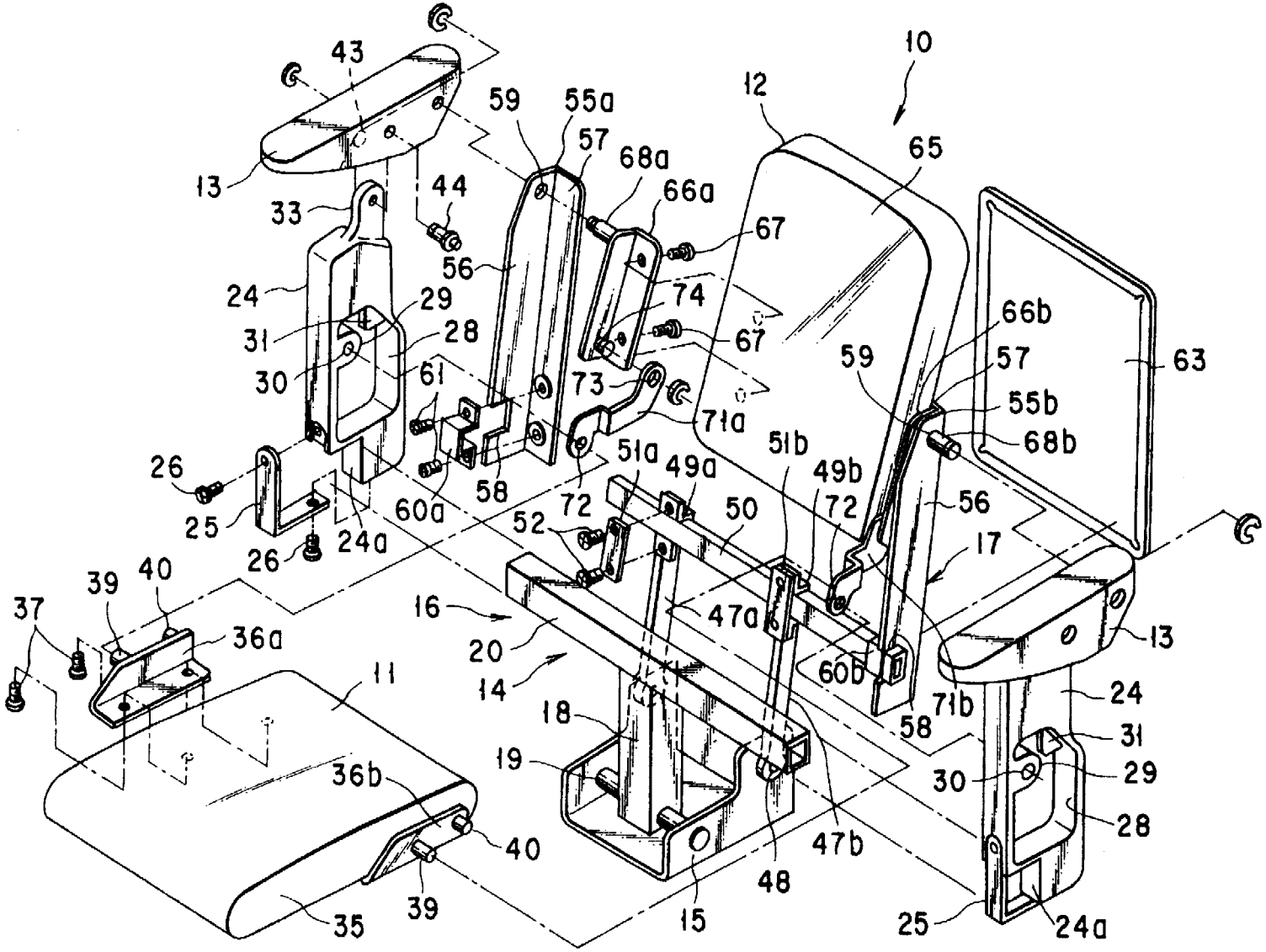
Figure 4:
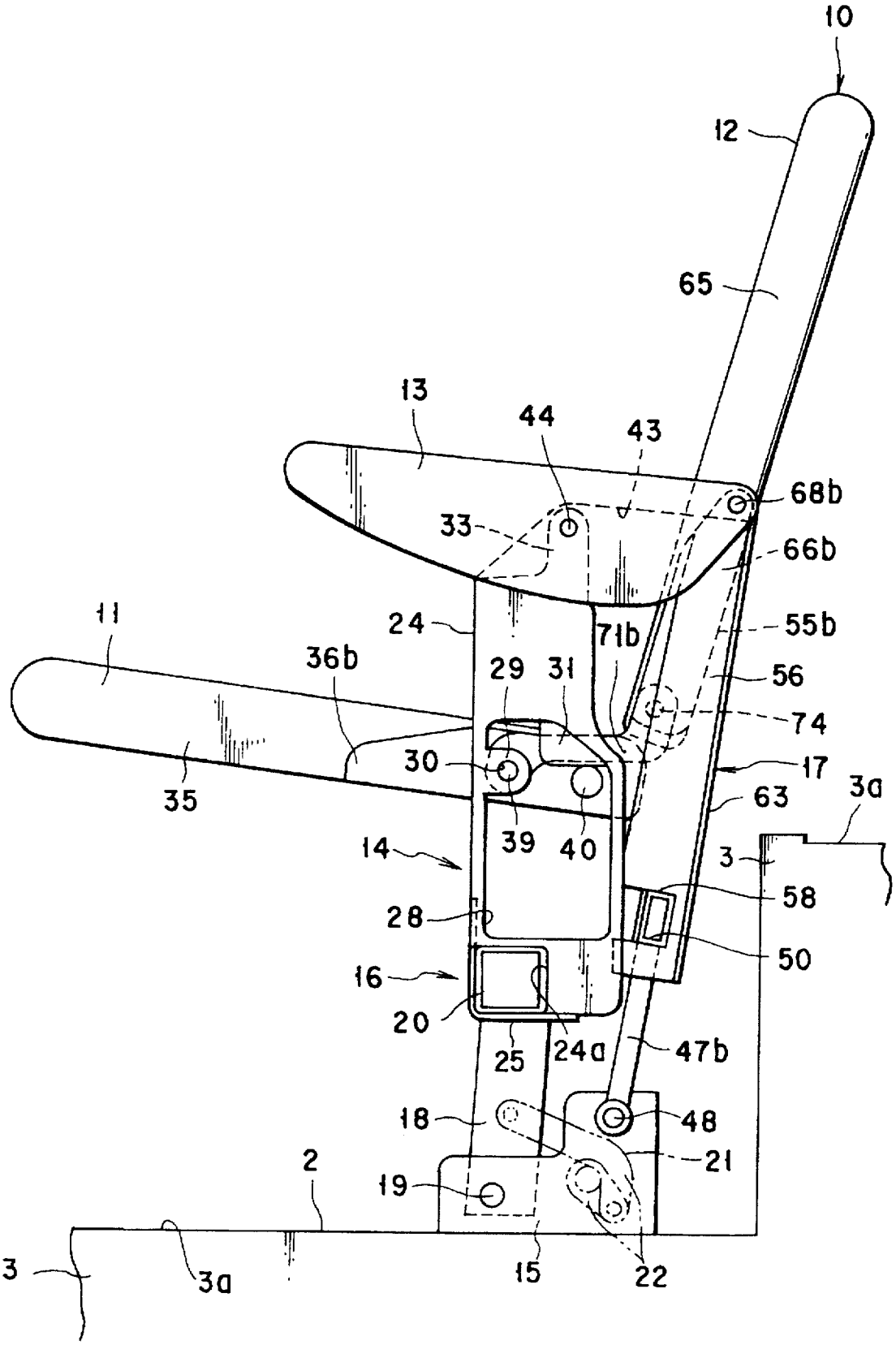

As shown in FIGS. 2 and 3, the first frame 16 has a beam 20. The beam 20 is provided to be parallel with the upper surface 2 of each of the decks 3, and to be extended in right and left directions along the upper surface 2. A plurality of support legs 18 are connected to the beam 20. The support legs 18 are provided to have a space in a longitudinal direction of the beam 20, and to be extended to cross at right angles. One end of each of these support legs 18 is rotatably connected to the front end of each of the bases 15. Due to this, the support legs 18 are rotatable between a position where the support legs 18 are substantially vertically raised from the upper surface 2 of each of the decks 3 and a position where the support legs 18 are substantially horizontally moved down to be parallel with the upper surface 2 of each of the decks 3. As shown in FIG. 4, the support legs 18 are interlocked by a driving device 21. The driving device 21 rotates the support legs 18 between the above two positions. The driving device 21 has a plurality of links 22 connected to the support legs 18, and a motor (not shown) for rotating these links 22.

As shown in FIG. 2 or 3, a plurality of supports 24 are attached to the beam 20 to have a distance in a longitudinal direction. These supports 24 are extended in a direction opposite to the above support legs 18 with respective to the beam 20. Each of the supports 24 has a concave portion 24*a* at the corner portion of one end, and the beam 20 is inserted to the concave portion 24*a*. An L-shape bracket 25 is fixed to the corner portion of one end of each support 24 with screws 26. The bracket 25 integrally connects the beam 20 to the supports 24. Due to this, the supports 24 can be rotated between a first position where the supports 24 are substantially vertically raised from the upper surfaces 2 of the decks 3 and a second position where the supports 24 are horizontally moved down along the upper surfaces 2 of the decks 3 by interlocking the rotation of each of the supports 18.

Each of the supports 24 has an opening portion 28. Each of the opening portions 28 is formed in each of the right and left surfaces of each of the supports 24. Also, each of the supports 28 has a boss portion 29. The boss portions 29 are projected to the inside of the opening portions 28, respectively, and bearing holes 30 are formed in the boss portions 29, respectively. Moreover, each of the supports 24 has a stopper wall 31. The stopper walls 31 are projected to the inside of the openings 28, respectively. In a state that the supports 24 are rotated to the first position, each of the stopper walls 31 is extended downward from the upper edge of each of the opening portions 28 to be positioned at the back of each of the boss portions 29. Furthermore, each of arm rest support sections 33 is integrally formed at the top end portion of each of the supports 24. Each of the arm rest support sections 33 is positioned at the opposite side of the beam 20.

As shown in FIGS. 2 and 3, the seat cushion 11 is provided between the adjacent supports 24. The seat cushion 11 comprises a square cushion body 35 and support metal fixtures 36*a* and 36*b*, which are provided at the right and left side portions of the cushion body 35, respectively. The support metal fixtures 36*a* and 36*b* are fixed to the lower surface of the cushion body 35 with a screw 37. Each of the support metal fixtures 36*a* and 36*b* comprises a rotational shaft 39 and a stopper pin 40. The rotational shafts 39 and the stopper pins 40 are formed to be parallel to each other, and to be projected to the side of the seat cushion 11, respectively. The rotational shafts 39 are positioned at the front portions of the stopper pins 40, respectively.

The rotational shafts 39 are rotatably inserted to the bearing holes 30 of the supports 24, respectively. Due to this, as shown in FIGS. 4 and 5, in a state that the supports 24 are rotated to the first position, the seat cushion 11 is supported by the supports 24 to be rotatable between the use position where the seat cushion 11 is horizontally extended in the back and forth directions to be substantially parallel to the upper surfaces 2 of the decks 3 and the storage position where the seat cushion 11 is raised substantially vertically along the supports 24.

Each of the stopper pins 40 enters the inside of the opening portions 28 of each of the supports 24. As shown in FIG. 4, if the seat cushion 11 is rotated to the use position, each of the stopper pins 40 comes in contact with each of the stopper walls 31. Thereby, the rotation of the seat cushion 11 is prevented, and the seat cushion 11 is maintained at the use position. Also, as shown in FIG. 5, if the seat cushion 11 is rotated to the storage position, each of the stopper pins 40 comes in contact with the inner peripheral surface of each of the opening portions 28. Thereby, the rotation of the seat cushion 11 is prevented, and the seat cushion 11 is maintained at the storage position.

Figure 5:
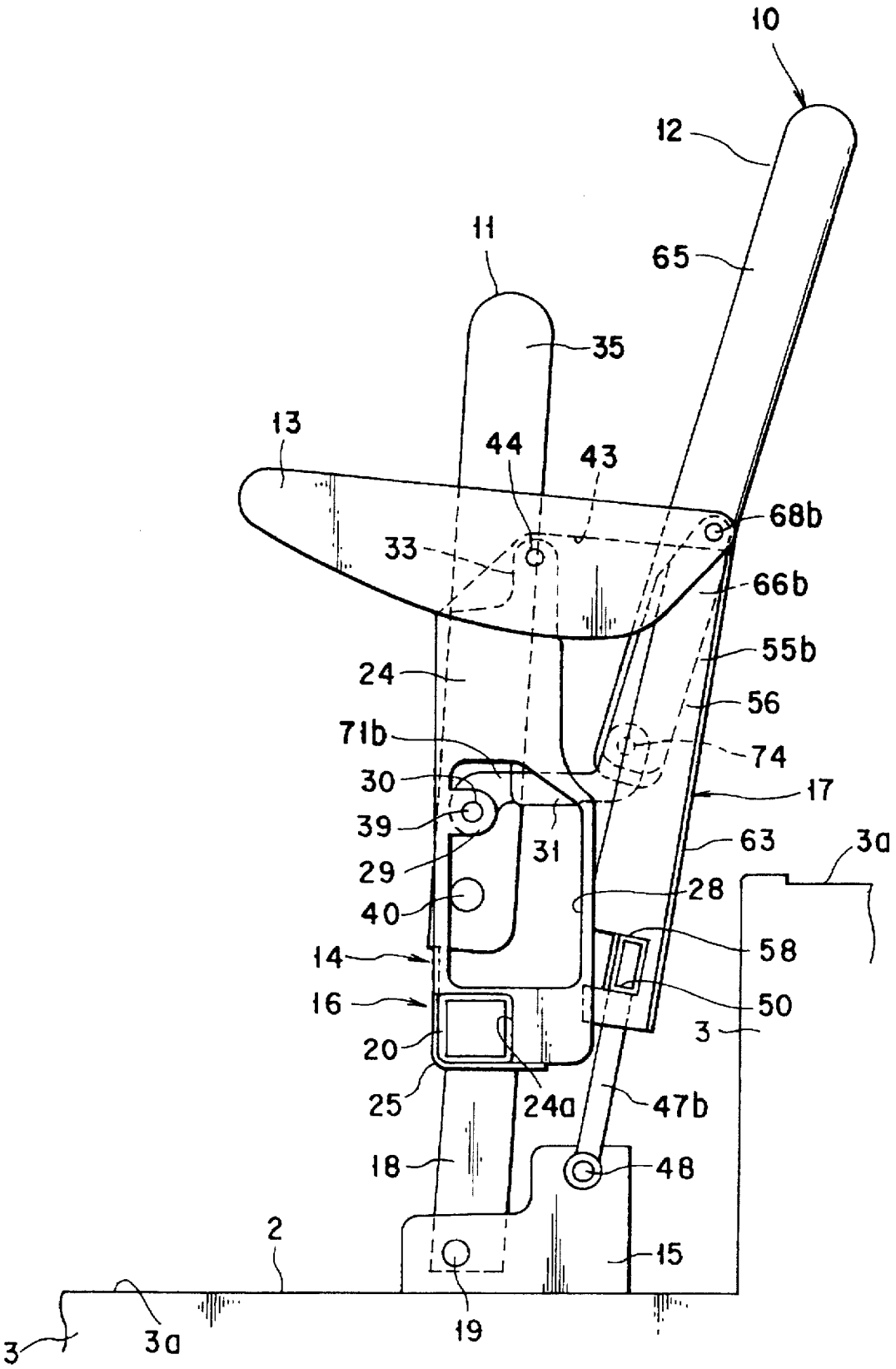

As shown in FIGS. 4 and 5, each of the arm rests 13 has a concave portion 43. Each of the concave portions 43 is continuously opened from the lower surface of each of the arm rests 13 to the rear surface. The arm rest support section 33 of each of the supports 24 is inserted to each of the concave portions 43 from the lower side. The arm rest support sections 33 are positioned at an intermediate portion in the back and forth directions of the arm rests 13, respectively. The arm rests 13 and the arm rest support sections 33 are rotatably connected to each other through first pivot shafts 44 in a vertical direction, respectively.

As shown in FIG. 3, the second frame 17 of the seat support frame 14 has a beam 50. The beam 50 is provided to be parallel with the upper surface 2 of each of the decks 3, and to be extended in right and left directions along the upper surface 2 at the back of the beam 20 of the first frame 16. A pair of rotational legs 47*a* and 47*b* are connected to the beam 50. The rotational legs 47*a* and 47*b* are provided at a plurality of portions having a space in a longitudinal direction of the beam 50. These rotational legs 47*a* and 47*b* are extended in a direction crossing at right angles with the beam 50. Each of beam receivers 49*a* and 49*b* is attached to one end of each of the rotational legs 47*a* and 47*b*, and the beam 50 is fitted into the beam receivers 49*a* and 49*b*. Each of beam brackets 51*a* and 51*b* is fixed to each of the beam receivers 49*a* and 49*b* with screws 52. The beam brackets 51*a* and 51*b* are integrally connects the beam 50 to the rotational legs 47*a* and 47*b*.

Figure 8:
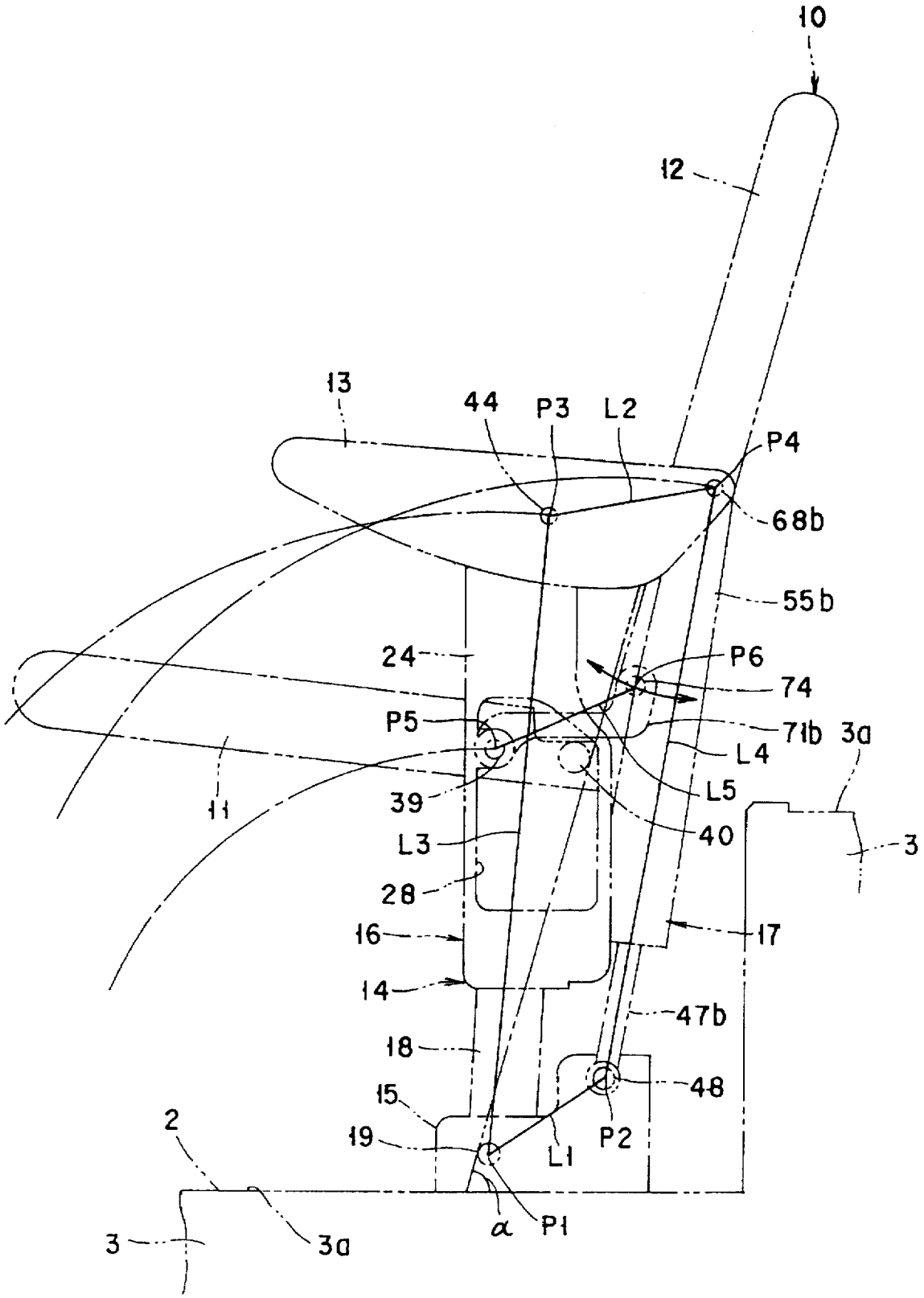
Figure 9:
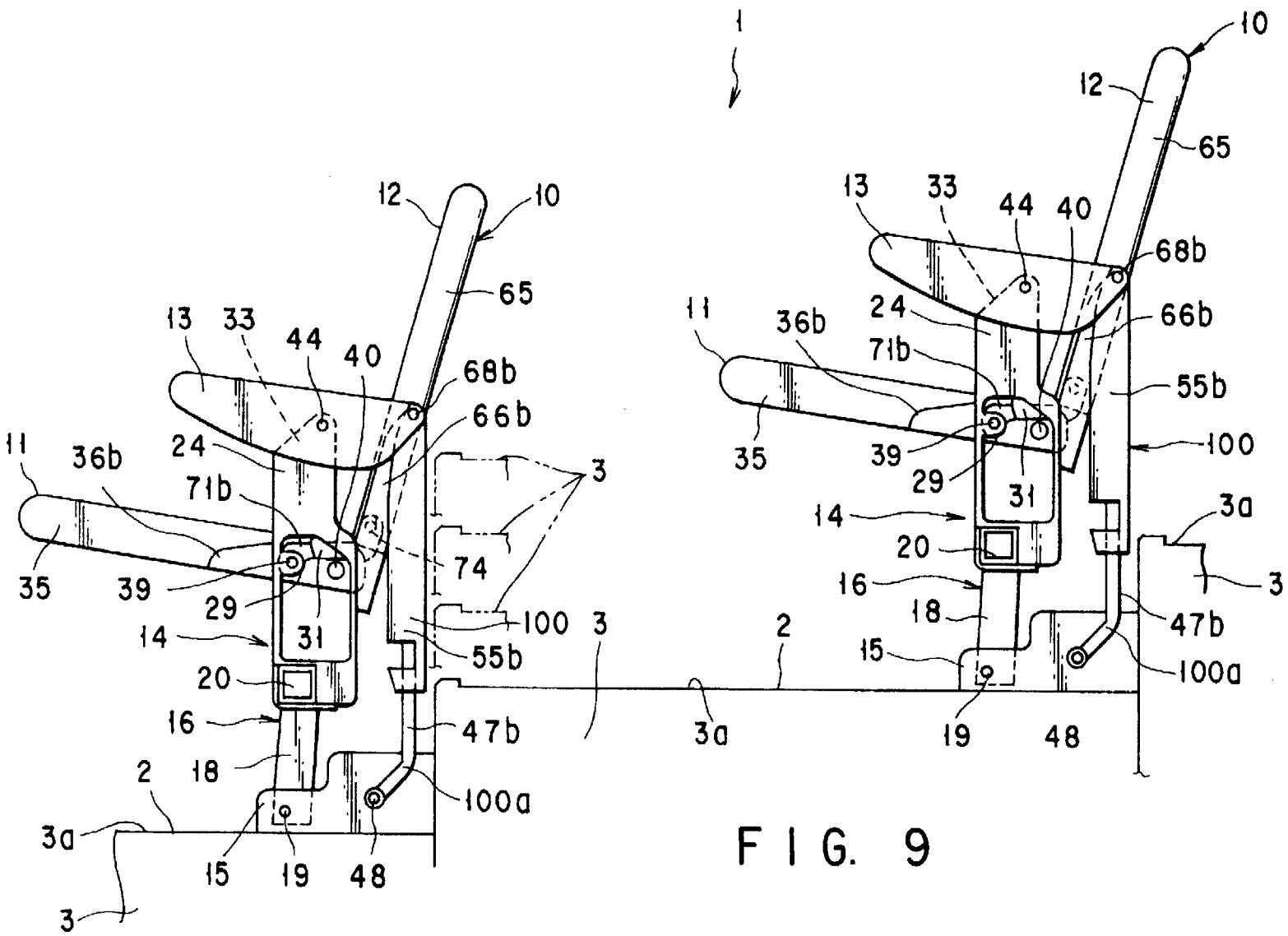
FIGS. 9 to 12 show a second embodiment of the present invention.

The other ends of the rotational legs 47*a* and 47*b* are rotatably connected to the back end portions of the base 15 in the back and forth directions. Due to this, the rotational legs 47*a* and 47*b* can be rotated between the raise position where the rotational legs 47*a* and 47*b* are substantially vertically raised from the upper surfaces 2 of the decks 3 and the folding position where the rotational legs 47*a* and 47*b* are horizontally moved down to be parallel to the upper surfaces 2 of the decks 3. Then, as shown in FIG. 8, a pivot point P1 of the support legs 18 and a pivot point P2 of the rotational legs 47*a* and 47*b* are positioned back and forth. The pivot point P2 of the rotational legs 47*a* and 47*b* is positioned upward than the pivot point P1 of the support legs 18.

As shown in FIG. 3, brackets 55*a* and 55*b* are attached to the beam 50. The brackets 55*a* and 55*b* are arranged at a plurality of portions separating from each other in a longitudinal direction of the beam 50 to be extended in a direction opposite to the rotational legs 47*a* and 47*b* with respective to the beam 50. The distance between the brackets 55*a* and 55*b* are set to be smaller than the distance between the supports 24.

The brackets 55*a* and 55*b* comprise side wall portions 56 and back wall portions 57 continuous to the side wall portions 56, respectively. Each of the side wall portion 56 has a concave portion 58 at its one end portion, and a bearing hole 59 at its other end. The beam 50 is fitted into the concave portions 58 of the side wall portions 56. The beam 50 crosses the front surface of one end portion of each of the back wall portions 57. Beam clampers 60*a* and 60*b* are fixed to the front surface of one end of each of the back wall portions 57 with screws 61. The beam clampers 60*a* and 60*b* hold the beam 50, which is fitted into the concave portions 58. Thereby, the beam 50 and the brackets 55*a* and 55*b* are integrally connected to each other. Due to this, the brackets 55*a* and 55*b* are rotated together with the rotational legs 47*a* and 47*b* in the back and forth direction.

A rear panel 63 is provided between the rear wall portions 57 of the brackets 55*a* and 55*b*. The rear panel 63 hides the beam 50 and a connecting section of the beam 50 and the rotational legs 47*a* and 47*b* from the back.

As shown in FIG. 3, the back rest 12 is provided between the brackets 55*a* and 55*b*. The back rest 12 comprises a square back rest body 65 and support metal fixtures 66*a* and 66*b*, which are provided at the right and left side portions of the back rest body 65, respectively. The support metal fixtures 66*a* and 66*b* are fixed to the back surface of the the back rest body 65 with screws 67. The support metal fixtures 66*a* and 66*b* have second pivot shafts 68*a* and 68*b*, respectively. Each of the second pivot shafts 68*a* and 68*b* is projected to the side portion of the back rest body 65 at one end of each of the support metal fixtures 66*a* and 66*b*. These second pivot shafts 68*a* and 68*b* are positioned at an intermediate portion along the height direction of the back rest body 65.

The second pivot shafts 68*a* and 68*b* are rotatably inserted to bearing holes 59 of the brackets 55*a* and 55*b*, respectively. Due to this, the back rest 12 is supported to be rotatable in the back and forth directions of the brackets 55*a* and 55*b*, and the upper half of the back rest 12 is projected to the upper portions of the brackets 55*a* and 55*b*.

As is obvious from FIG. 3, the second pivot shafts 68*a* and 68*b* are projected to the side portions of the brackets 55*a* and 55*b* through the bearing holes 59, respectively. The top end portions of the second pivot shafts 68*a* and 68*b* are rotatably connected to the back end portions of the arm rests 13, respectively. Due to this, the second pivot shafts 68*a* an 68*b* support both the arm rests 13 and the back rest 12 to be rotatable to the brackets 55*a* and 55*b*. The arm rests 13 are substantially horizontally provided to be stretched between the supports 24 and the brackets 55*a* and 55*b*. Then, the arm rests 13 are connected to the supports 24 and the brackets 55*a* and 55*b* to be rotatable in a vertical direction, respectively. Due to this, the arm rests 13 function as connection rods for interlocking the supports 24 and the brackets 55*a* and 55*b* each other.

As shown in FIG. 8, a distance between the pivot point P1 of the support legs 18 and the pivot point P2 of the rotational legs 47*a* and 47*b* is set to L1, and a distance between a pivot point P3 of the supports 24 and the arm rests 13 and a pivot point P4 of the brackets 55*a* and 55*b* and the arm rests 13 is set to L2. L2 is set to be larger than L1. Similarly, a distance between the pivot point P1 and the pivot point P3 is set to L3, and a distance between the pivot point P2 and the pivot point P4 is set to L4. L3 set to be larger than L4. Therefore, if it is assumed that each of L1 to L4 is regarded as one link, the base 15, the first frame 16, the second frame 17, and the arm rests 13 form a quadric crank chain. As shown in FIG. 4, if the supports 24 are rotated to the first position, the movement of the supports 24 is transmitted to the brackets 55*a* and 55*b* through the arm rests 13, and the brackets 55*a*, 55*b*, and the rotational legs 47*a* and 47*b* are rotated to the raise position where the brackets 55*a*, 55*b* and the rotational legs 47*a* and 47*b* are substantially upright raised from the upper surfaces 2 of the decks 3. In a state that the brackets 55*a* and 55*b* are rotated to the raise position, the rear panel 63 is raised just before a higher step 3*a*, which is positioned at the back of the rear panel 63.

Figure 6:
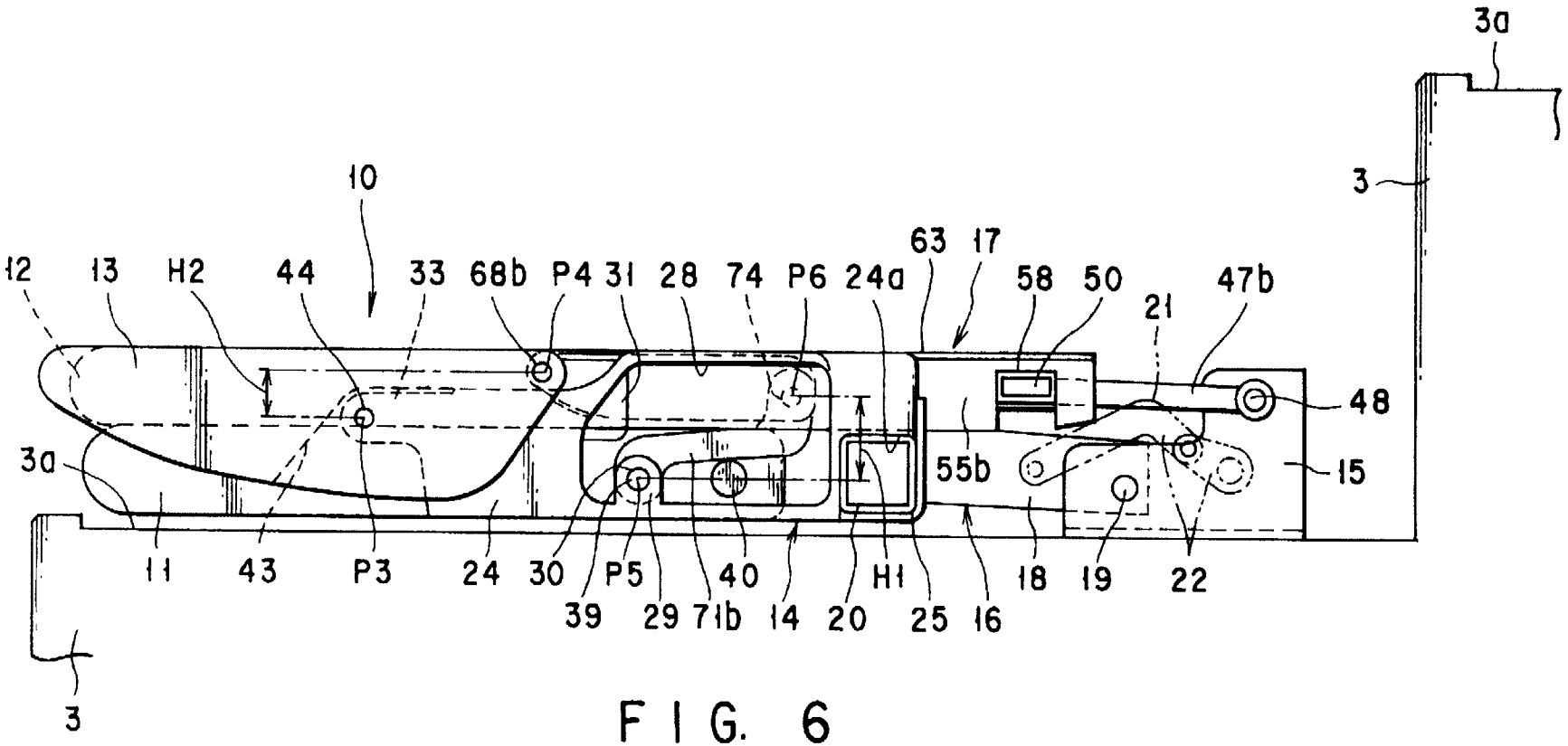
Figure 7:
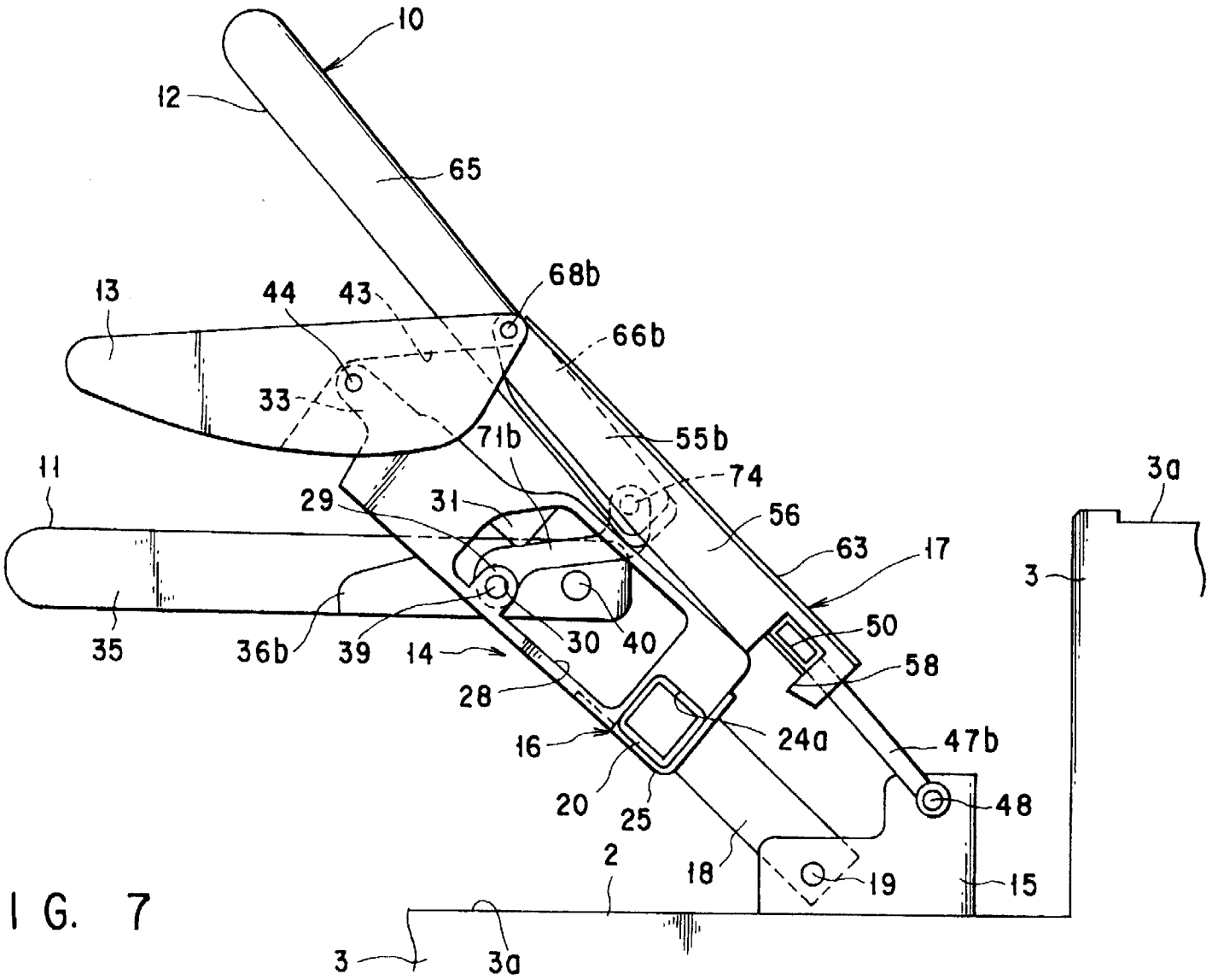

As shown in FIG. 6, if the supports 24 are rotated to the second position, the movement of the supports 24 is transmitted to the brackets 55*a* and 55*b* through the arm rests 13, and the brackets 55*a*, 55*b*, and the rotational legs 47*a* and 47*b* are rotated to the folding position where the brackets 55*a*, 55*b* and the rotational legs 47*a* and 47*b* are set to be parallel to the upper surfaces 2 of the decks 3. In a state that the brackets 55*a* and 55*b* are rotated to the folding position, the brackets 55*a* and 55*b*, and the supports 24 become substantially parallel to each other, and the brackets 55*a* and 55*b* enter between the supports 24.

As shown in FIGS. 3 and 4, the back rest 12 and the supports 24 are interlocked each other through a pair of link members 71*a* and 71*b*. The link members 71*a* and 71*b* are extended in the back and forth directions of the seat 10. The link members 71*a* and 71*b* have bearing holes 72 and 73 in their front and back ends, respectively. The front end portions of the link members 71*a* and 71*b* are interposed between the seat cushion 11 and the supports 24. Then, the rotational shafts 39 of the seat cushion 11 are rotatably inserted to the bearing holes 72 formed at the front ends of these link members 71*a* and 71*b*. Due to this, the rotational shafts 39 of the seat cushion 11 are used such that the front ends of the link members 71*a* and 71*b* are supported by the supports 24.

The back end portions of the link members 71*a* and 71*b* are interposed between the side surface of the back rest body 65 and the support metal fixtures 66*a* and 66*b*, respectively. The back end portion of each of the link members 71*a* and 71*b* is supported to be rotatable to the support metal fixtures 66*a* and 66*b* by inserting a pivot shaft 74 to the bearing hole 73. Each of the pivot shafts 74 is positioned close to the lower end portion of the back rest 12.

As shown in FIG. 8, a pivot point of the supports 24 and the front ends of the link members 71*a* and 71*b* is set to P5, and a pivot point of the back rest 12 and the back ends of the link members 71*a* and 71*b* is set to P6. A distance L5 between the pivot points P5 and P6 is set to be smaller than the distance L2. Also, the pivot point P6 is positioned at the upper portion than the pivot point P5. Due to this, in a state that the supports 24 are rotated to the first position, the lower end portion of the back rest 12 is drawn forward through the link members 71*a* and 71*b* based on a difference between the distances L2 and L5, so that the back rest 12 is moved down to the brackets 55*a* and 55*b*. Thereby, an inclination angle $\alpha$ of the back rest 12 is increased.

As shown in FIG. 6, if the supports 24 are rotated from the first position to the second position, the link members 71*a* and 71*b* come in contact with the stopper pins 40 of the seat cushion 11 from the upper side, respectively. Thereby, the seat cushion 11 is maintained to be parallel to the supports 24. At the same time, the backets 55*a* and 55*b* enter between the supports 24, and the back rest 12 is overlaid on the seat cushion 11. As mentioned above, L4 is smaller than L3. Due to this, if the supports 24 and the brackets 55*a* and 55*b* are rotated to the second position, the pivot point P4 of the arm rests 13 is positioned at the back of the pivot point P3 of the arm rests 13, so that the arm rests 13 are rotated to be extended along the supports 24. Due to this, the seat 10 is folded to be flatly shaped along the upper surfaces 2 of the decks 3.

As shown in FIG. 6, in a state that the seat 10 is folded, the link members 71*a* and 71*b* are maintained to be extended in the back and forth directions. Then, the pivot point P6 of the link members 71*a* and 71*b* is positioned at the upper portion of the pivot P5. A distance H1 between the pivot points P5 and P6 in the up and down directions is larger than a distance H2 between the pivot points P3 and P4 in the up and down directions. Due to this, if the supports 24 are rotated to the second position, the lower end portion of the back rest 12 is pushed upward, so that the back surface of the back rest 12 is formed to be continuous to the rear panel 63. Therefore, in a state that the seat 10 is folded, a thickness of the seat 10 is substantially the same as the base 15, and the seat 10 can be stored in the storage space 6.

According to the above-structured seating system 1, the back rest 12 and the supports 24 are interlocked each other through the link members 71*a* and 71*b*. Due to this, if the supports 24 are rotated from the second position to the first position, the lower end portion of the back rest 12 is drawn forward. Therefore, as compared with the conventional seat, the inclination angle α of the back rest 12 is increased, so that the inclination angle of the back rest 12 can be suitably set when the audience seats the seat 10.

The second pivot shafts 68*a* and 68*b*, serving as rotation fulcrums of the back rest 12, are used as rotation fulcrums of the brackets 55*a*, 55*b* and the arm rests 13. Due to this, the rotation fulcrums of the arm rests 13 and the back rest 12 can be used in common to each other. Due to this, though the back rest 12 is provided to be rotatable to the brackets 55*a* and 55*b*, the shaft dedicated to pivotably support the back rest 12 is not needed. Also, the bearing portion for receiving the shaft can be omitted from the brackets 55*a* and 55*b*. Therefore, the number of parts can be reduced, the structure can be simplified, and the cost of the seat 10 can be decreased.

In the state that the supports 24 are rotated to the first position, the back rest 12 of the seat 10 is inclined to be expanded to the back of the rear panel 63. Due to this, if the back rest 12 is horizontally moved down, the inclination of the front end of the back rest 12 is maintained to be positioned to be upper than the back end. As a result, the back rest 12 is not positioned to be parallel to the upper surfaces 2 of the decks 3.

However, according to the above-mentioned structure, if the supports 24 are rotated from the first position to the second position, the lower end portion of the back rest 12 is pushed up through the link members 71*a* and 71*b*. Due to this, the back surface of the back rest 12 is substantially horizontally extended along the upper surfaces 2 of the decks 3 to be continuous to the rear panel 63 in a state that the back surface is substantially flush with the rear panel 63. As a result, the thickness of the seat 10, which is obtained when being folded, becomes smaller.

Due to this, in the state that the plurality of decks 3 are stacked in a shelf form such that the lower deck 3 enters the space positioned at the lower side of the higher deck 3 and the seating system 1 is stored in the wall surface of the multi-purpose facility, the folded seat 10 can be stored in the storage space 6 formed between the decks 3 without difficulty.

Moreover, if the thickness of the folded seat 10 becomes small, the seat 10 can be stored in the storage space 6 even if the level difference S between the upper surfaces 2 of the decks 3 is low in the seating system 1, so that there is an advantage in improvement of the wide use.

The present invention is not limited to the above-explained first embodiment. The following will explain a second embodiment of the present invention with reference to FIGS. 9 to 12.

According to the second embodiment of the present invention, the structure of a second frame 100 for rotatably supporting the back rest 12 is different from the first embodiment, and the other structure of the second embodiment is the same as the first embodiment. Due to this, in the second embodiment, the same reference numerals as the first embodiment are added to the portions common to the first embodiment, and the explanation is omitted.

Figure 12:
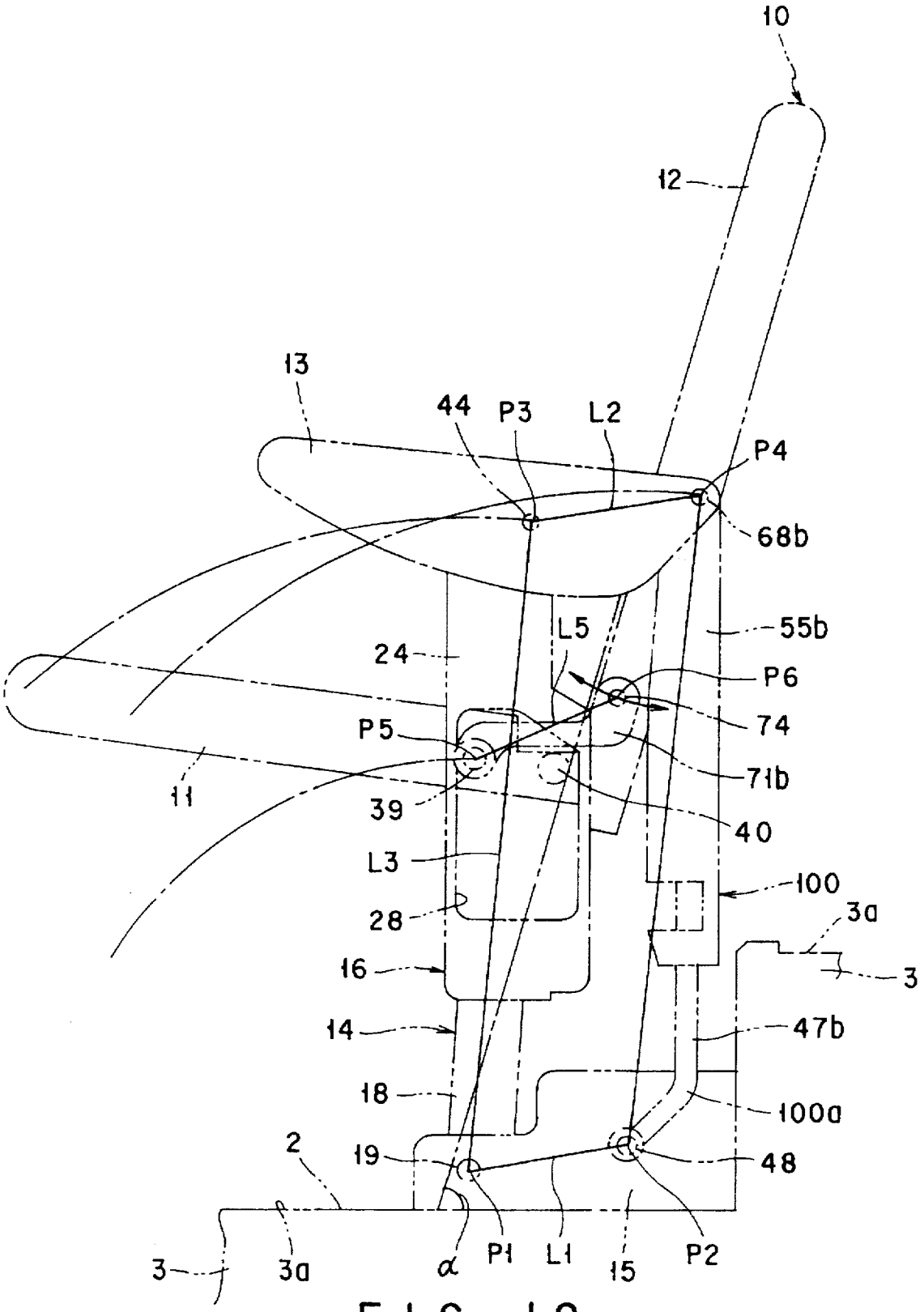

As shown in FIG. 12, in the second frame 100, the pivot point P2 of the rotational legs 47*a* and 47*b* is shifted to a backward position of the seat 10 than the case of the first embodiment. These rotational legs 47*a* and 47*b* have a bend portion 100*a* between the pivot point P2 and the beam 50. Due to this, if the second frame 100 is rotated to the first position, the brackets 55*a* and 55*b* of the second frame 100 are structured to be perpendicularly raised from the upper surfaces 2 of the decks 3. The rear panel 63 provided between the rear wall portions 57 of the brackets 55*a* and 55*b* is perpendicularly raised just before the adjacent higher steps 3*a*. In the state that the brackets 55*a* and 55*b* are rotated to the raise position, the upper end portion of the rear panel 63 reaches the place close to an intermediate section along the height direction of the back rest 12. The rear panel 63 is projected to the upper portion than the upper surfaces 2 of the steps 3*a*.

As shown in FIG. 12, in the state that the supports 24 and the brackets 55*a* and 55*b* are rotated to the first position, the lower end portion of the back rest 12 is drawn forward through the link members 71*a* and 71*b*, and the upper portion of the back rest 12 is extended to a backward position than the brackets 55*a* and 55*b*. Thereby, the inclination angle α of the back rest 12 to the upper surfaces 2 of the decks 3 is increased.

Figure 11:
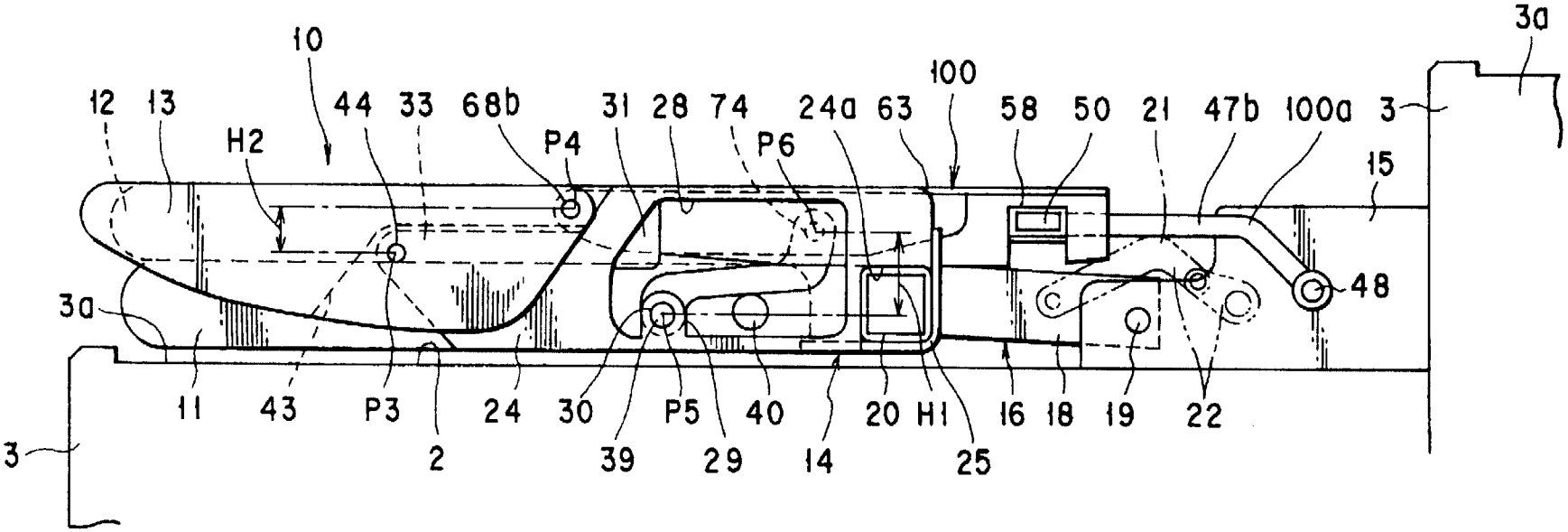

As shown in FIG. 11, if the supports 24 are rotated to the second position from the first position, the link members 71*a* and 71*b* come in contact with the stopper pins 40 of the seat cushion 11 from the upper side, so that the seat cushion 11 is held to be parallel to the supports 24. At the same time, the brackets 55*a* and 55*b* enter between the supports 24, and the back rest 12 is overlaid on the seat cushion 11. Moreover, if the supports 24 are rotated to the second position, the pivot point P4 of the arm rests 13 is positioned at the back of the pivot point P3 of these arm rests 13, so that the arm rests 13 are rotated to be extended in parallel along the supports 24. Due to this, the seat 10 is folded to be shaped flat along the upper surfaces 2 of the decks 3.

In this case, as shown in FIG. 11, the link members 71*a* and 71*b* are maintained to be extended in the back and forth directions. Then, the distance H1 between the pivot points P5 and P6 of the link members 71*a* and 71*b* in the up and down directions is larger than the distance H2 between the pivot points P3 and P4 of the arm rests 13 in the up and down directions. Due to this, if the supports 24 are rotated to the second position, the lower end portion of the back rest 12 is pushed upward, so that the back surface of the back rest 12 is formed to be continuous to the rear panel 63 to be substantially flush with the rear panel 63. Therefore, in the state that the seat 10 is folded, the thickness of the seat 10 is substantially the same with the base 15, so that the seat 10 can be stored in the storage space 6 without difficulty.

According to the above-structured second embodiment, the back rest 12 and the supports 24 are interlocked each other through the link members 71*a* and 71*b*. Due to this, if the supports 24 are rotated to the first position from the second position, the lower end portion of the back rest 12 is drawn forward by the link members 71*a* and 71*b*. Therefore, the inclined angle $\alpha$ of the back rest 12 is increased, the inclination angle of the back rest 12 can be suitably set when the audience seats the seat 10.

Figure 10:
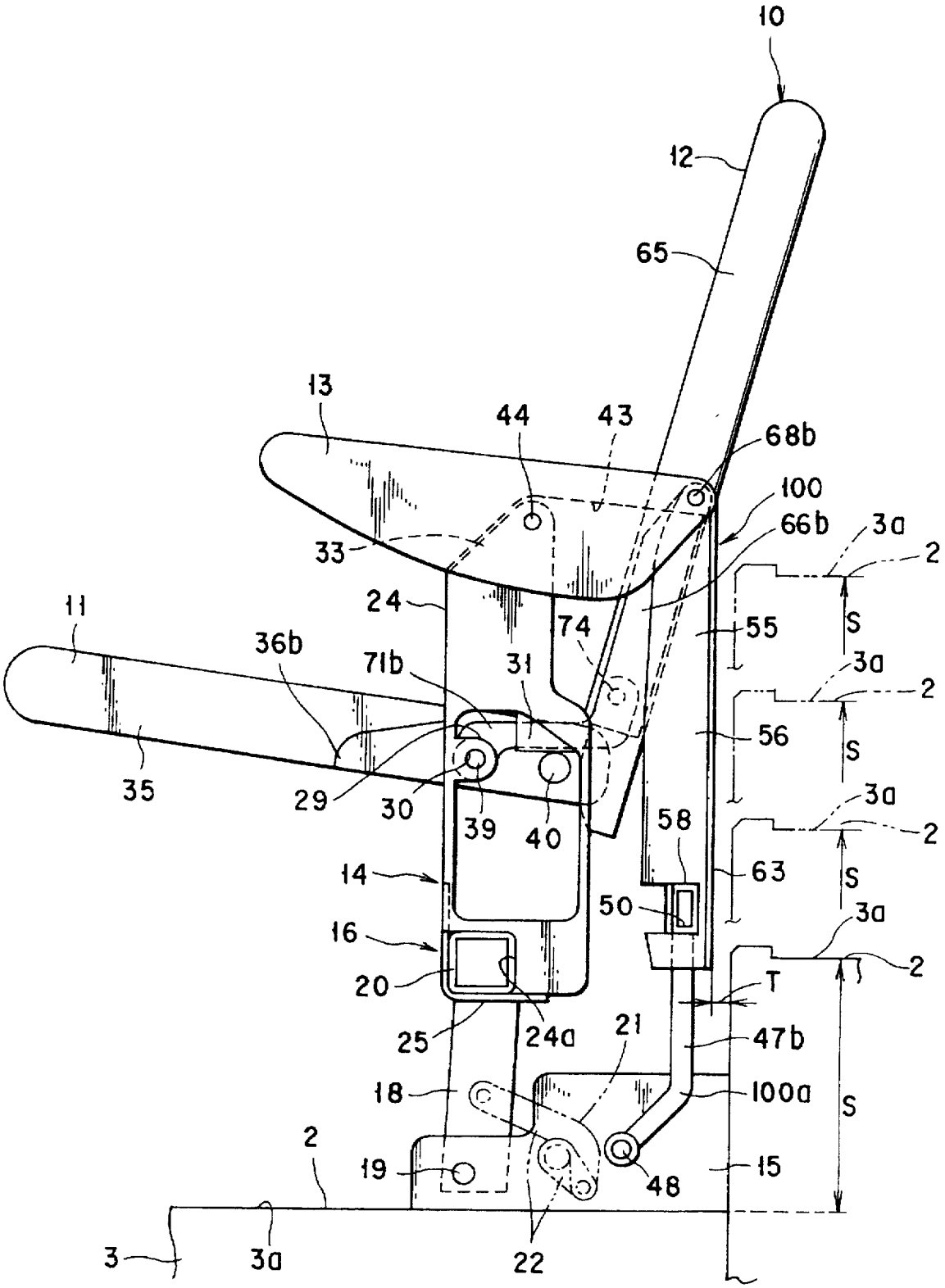

Moreover, if the supports 24 are rotated to the first position, and the seat 10 is expanded to the usable state, the rear panel 63, which is continuous to the back rest 12, is uprightly provided just before the higher decks 3 provided backward. Due to this, as shown in FIG. 10, even if the level difference S between the upper surfaces 2 is changed in accordance with the specification of the seating system 1, the front ends of the upper surfaces 2 are moved up and down along the rear panel 63, and a distance T between the front ends of the upper surfaces 2 and the rear panel 63 can be constantly maintained. Thereby, it is not needed that the attaching position of the seat 10 be shifted back and forth in accordance with the level difference S between the upper surfaces 2. Moreover, it is not required that the height of the attachment be adjusted up and down. Therefore, the attachment of the seat 10 to the decks 3 can be easily made.

Furthermore, if the supports 24 are rotated to the second position from the first position, the back rest 12 is substantially horizontally extended along the upper surfaces 2 of the steps 3*a*, so that the back rest 12 is continuous to the rear panel 63 to be flush therewith. Then, the thickness of the seat 10 becomes small when the seat 10 is folded. Due to this, the folded seat 10 can be stored to the storage space 6 formed between the decks 3 without difficulty. Particularly, this is favorable in the case of the narrow storage space 6 as described in the seating system 1 in which the level difference S between the upper surfaces 2 is set to be low.

The present invention is not limited to the above-explained embodiment. For example, a spring is attached to the supporting section of the seat cushion. Then, the seat cushion may be structured to automatically spring up to the intermediate position between the storage position and the use position when the audience is away from the seat cushion.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A folding seat comprising:

a first frame mounted on a floor surface, said first frame rotatable between a raised position where said first frame is raised from said floor surface and a horizontally laid position where said first frame is laid along said floor surface;

a seat cushion supported by said first frame, said seat cushion rotatable between a horizontal position where said seat cushion is horizontally extended from said first frame, when said first frame is rotated to said raised position, and a storage position where said seat cushion is laid along said first frame when said first frame is rotated to said raised position;

a second frame mounted on said floor surface at the back of said first frame, said second frame rotatable between a raised position where said second frame is raised from said floor surface and a horizontally laid position where said second frame is laid along said floor surface;

an arm rest stretched between said first and said second frames, said arm rest rotatably connected to said first frame through a first pivot shaft, said arm rest rotatably connected to said second frame through a second pivot shaft, and said first and second frames interlocked to each other through said arm rest;

a back rest rotatably supposed on said second frame through said second pivot shaft, said back rest having a lower end potion facing to a rear end potion of said seat cushion and said back rest extending upwardly from said rear end potion of said seat cushion when said second frame is rotated to said raised position, and said back rest being laid along said seat cushion when said second frame is rotated to said horizontally laid position; and a link member stretched between said back rest and said first frame, said link member having one end rotatably connected to said back rest and other end rotatably connected to said first frame, and said link member rotating said back rest in a direction where the lower end portion of said back rest is drawn forward to form an incline relative to said second frame when said first and second frames are rotated to the raised position from the horizontally laid position.

2. The folding seat according to claim 1, wherein said link member rotates said back rest along said first frame when said first and second frames are rotated from the raised position to the horizontally laid position.

3. The folding seat according to claim 1, further comprising a stopper for maintaining said seat cushion at the horizontal position when said first frame is rotated to the raised position, and maintaining said seat cushion at the storage position when said first and second frames are rotated to the horizontally laid position.

4. The folding seat according to claim 1, further comprising movable decks, wherein said first and second frames are rotatably supported by said movable decks along said floor surface, and wherein said movable decks having wheels at their lower end portions, wherein said wheels rotate along said floor surface.

5. The folding seat according to claim 4, wherein said movable decks comprises a plurality of steps having upper surfaces, wherein each said upper surface is positioned at a different height from said floor surface, wherein said steps are mounted on the floor surface to be movable between a storage position where the upper surfaces are stacked in a shelf form, and a horizontal position where the upper surfaces are expanded stepwise, and said movable decks have a storage space between the upper surfaces stacked against each other when said movable steps are moved to said storage position.

6. The folding seat according to claim 5, wherein the thickness of said seat cushion and said back rest is predetermined so that, when the back rest is laid along said seat cushion when said second frame is rotated to the horizontally laid position, both the seat cushion and the back rest can be stored in said storage space.

7. A seating system having a floor surface, stepwise decks each having a front end and a rear end, and a seat, said stepwise decks having a plurality of upper surfaces, wherein each said upper surface is positioned at a different height from said floor surface, said upper surfaces adjacent to each other and having height being increased accordingly as advancing from the front end of each of said stepwise decks to the rear end of each of said stepwise decks, and said seat positioned on said upper surfaces of said stepwise decks, said seat comprising:

a first frame mounted on each of said upper surfaces of said stepwise decks, said first frame rotatable between a raised position where said first frame is raised from said upper surfaces and a horizontally laid position where said first frame is laid along said upper surfaces;

a seat cushion supposed by said first frame, said seat cushion rotatable between a horizontal position where said seat cushion is horizontally extended from said first frame, when said first frame is rotated to said raised position, and a storage position where said seat cushion is raised along said first frame rotated to said raised position;

a second frame mounted on each of said upper surfaces of said stepwise decks at a back of said first frame, said second frame rotatable between a raised position where said second frame is raised from said upper surfaces and a horizontally laid position where said second frame is laid along said upper surfaces, said second frame having a rear panel, said rear panel raised at a position adjacent to a front end of said upper surfaces and positioned upwardly from said upper surfaces when said second frame is rotated to the raised position, and said rear panel having an upper end projected upwardly from said upper surface positioned at the back of said first frame;

an arm rest stretched between said first and said second frames, said arm rest rotatably connected to said first frame through a first pivot shaft, said arm rest rotatably connected to said second frame through a second pivot shaft, and said first and second frames interlocked to each other through said arm rest;

a back rest rotatably supported on said second frame through said second pivot shaft, said back rest extending upwardly from the upper end of said, rear panel when said second frame is rotated to said raised position, and said back rest is inclined to a front of said rear panel; and a link member stretched between said back rest and said first frame, said link member having one end rotatably connected to said back rest and other end rotatably connected to said first frame, and said link member rotating said back rest to be parallel to said rear panel when said first and second frames are rotated from the raised position to the horizontally laid position.

8. The seating system according to claim 1, wherein said link member rotates said back rest so that a lower end portion of said back rest is drawn forward, when said first and second frames are rotated to the raised position from the horizontally laid position.

9. The seating system according to claim 1, wherein said stepwise decks are expandable and contractible between a storage position, when said upper surfaces are stacked on each other in a shelf form, and a horizontal position, when said upper surfaces are expanded stepwise, and each of said stepwise decks has a space for storing said seat between said upper surfaces stacked on each other.

* * * * *